US010468178B2

(12) United States Patent
Kainaga et al.

(10) Patent No.: US 10,468,178 B2
(45) Date of Patent: Nov. 5, 2019

(54) STATIONARY INDUCTION APPARATUS

(71) Applicant: Mitsubishi Electric Corporation, Chiyoda-ku (JP)

(72) Inventors: Soichiro Kainaga, Chiyoda-ku (JP); Shigeyoshi Yoshida, Chiyoda-ku (JP); Takahiro Umemoto, Chiyoda-ku (JP); Takao Tsurimoto, Chiyoda-ku (JP)

(73) Assignee: Mitsubishi Electric Corporation, Chiyoda-ku (JP)

( * ) Notice: Subject to any disclaimer, the term of this patent is extended or adjusted under 35 U.S.C. 154(b) by 0 days.

(21) Appl. No.: 15/673,560

(22) Filed: Aug. 10, 2017

(65) Prior Publication Data

US 2018/0053597 A1 Feb. 22, 2018

(30) Foreign Application Priority Data

Aug. 19, 2016 (JP) ..... 2016-161218
Jun. 20, 2017 (JP) ..... 2017-120598

(51) Int. Cl.
*H01F 27/36* (2006.01)
*H01F 27/28* (2006.01)
*H01F 27/32* (2006.01)

(52) U.S. Cl.
CPC ..... *H01F 27/362* (2013.01); *H01F 27/2823* (2013.01); *H01F 27/327* (2013.01)

(58) Field of Classification Search
CPC .. H01F 27/362; H01F 27/327; H01F 27/2823; H01F 27/2885; H01F 27/288; H01F 27/2871; H01F 27/36; H01F 27/32; H01F 27/323; H01F 27/324
USPC ..... 336/84 C, 84 R, 170, 221, 205, 206
See application file for complete search history.

(56) References Cited

U.S. PATENT DOCUMENTS 2,318,068 A * 5/1943 Elsner ..... H01F 27/343 336/184
4,317,096 A * 2/1982 Degeneff ..... H01F 27/006 336/70
4,352,078 A * 9/1982 Moore ..... H01F 27/18 336/197
2018/0025833 A1* 1/2018 Kainaga et al. .... H01F 27/2885 336/177

FOREIGN PATENT DOCUMENTS

JP 60-113614 U 8/1985
JP 63-209112 8/1988
JP 2010-251543 11/2010
JP 2012-195412 10/2012

OTHER PUBLICATIONS

U.S. Appl. No. 15/355,309, filed Nov. 18, 2016, 2017/0169938 A1, Soichiro Kianaga, et al.

* cited by examiner

*Primary Examiner* — Mang Tin Bik Lian
(74) *Attorney, Agent, or Firm* — Oblon, McClelland, Maier & Neustadt, L.L.P.

(57) ABSTRACT

A stationary induction apparatus includes a core, a winding wound around the core such that the core serves as a central axis, and an annular electrostatic shield disposed adjacent to at least one of ends of the winding in a direction along the central axis. The electrostatic shield includes a conductor and a second insulating coating that coats the conductor. The electrostatic shield has a potential lower than a highest potential in the winding.

14 Claims, 11 Drawing Sheets

STATIONARY INDUCTION APPARATUS

BACKGROUND OF THE INVENTION

Field of the Invention

The present invention relates to a stationary induction apparatus, and particularly, to a stationary induction apparatus including an electrostatic shield.

Description of the Background Art

When an impulse voltage such as lightning surge enters a stationary induction apparatus such as a transformer or a reactor, the potential distribution in a winding becomes steep compared with a potential distribution proportional to the number of turns, and then, oscillations occur around the potential distribution proportional to the number of turns. This phenomenon is referred to as potential oscillations. If potential oscillations have a large amplitude, a dielectric breakdown may occur due to a large potential difference generated between adjacent electric wires in a winding and between adjacent windings. When electrostatic shields are installed adjacent to windings, the electrostatic capacitance between the windings becomes larger than the electrostatic capacitance between the winding and the ground, thus reducing the amplitude of potential oscillations.

A transformer including electrostatic shields as conventional has the electrostatic shields provided at opposite ends of a winding in the direction of its central axis. Each of an end on an outer peripheral side and an end on an inner peripheral side of the electrostatic shield is formed as a curved surface. The electrostatic shield is fixedly fastened to the winding in the direction of the central axis of the winding and has a width equivalent to the width of the winding in the radial direction of the winding (see Japanese Utility Model Laying-Open No. 60-113614 for example).

The electrostatic shields of the transformer as conventional, on a side thereof opposite to that thereof adjacent to a coil, has a portion at an end on an outer peripheral side and an end on an inner peripheral side where an electric field is concentrated. When the respective curvature radii of the outer peripheral ends and inner peripheral ends of the electrostatic shields are increased to reduce electric field concentration on the outer peripheral ends and inner peripheral ends of the electrostatic shields, the electrostatic shields become thicker, increasing the size of a stationary induction apparatus.

SUMMARY OF THE INVENTION

The present invention has been made to solve the problem above, and has an object to provide a stationary induction apparatus that can reduce electric field concentration at an end on an outer peripheral side and an end on an inner peripheral side of an electrostatic shield while restraining the electrostatic shield from thickening.

A stationary induction apparatus according to the present invention includes a core, at least one winding wound around the core such that the core serves as a central axis, and at least one annular electrostatic shield disposed adjacent to at least one of ends of the at least one winding in a direction along the central axis in a one-to-one correspondence. The at least one winding includes an electric wire portion and a first insulating coating that coats the electric wire portion. The at least one electrostatic shield includes a conductor and a second insulating coating that coats the conductor. The at least one electrostatic shield has a potential lower than a highest potential in the at least one winding.

The present invention can reduce electric field concentration at an end on an outer peripheral side and an end on an inner peripheral side of an electrostatic shield while restraining the electrostatic shield from thickening.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
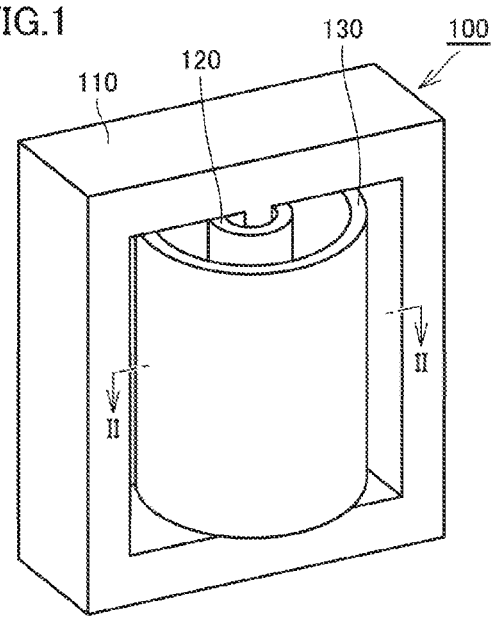
FIG. 1 is a perspective view showing an appearance of a stationary induction apparatus according to a first embodiment of the present invention.

Stationary induction apparatuses according to embodiments of the present invention will be described hereinafter with reference to the drawings. In the following embodiments, the same or corresponding components are denoted by the same reference characters, and a description thereof will not be repeated.

First Embodiment

Figure 2:
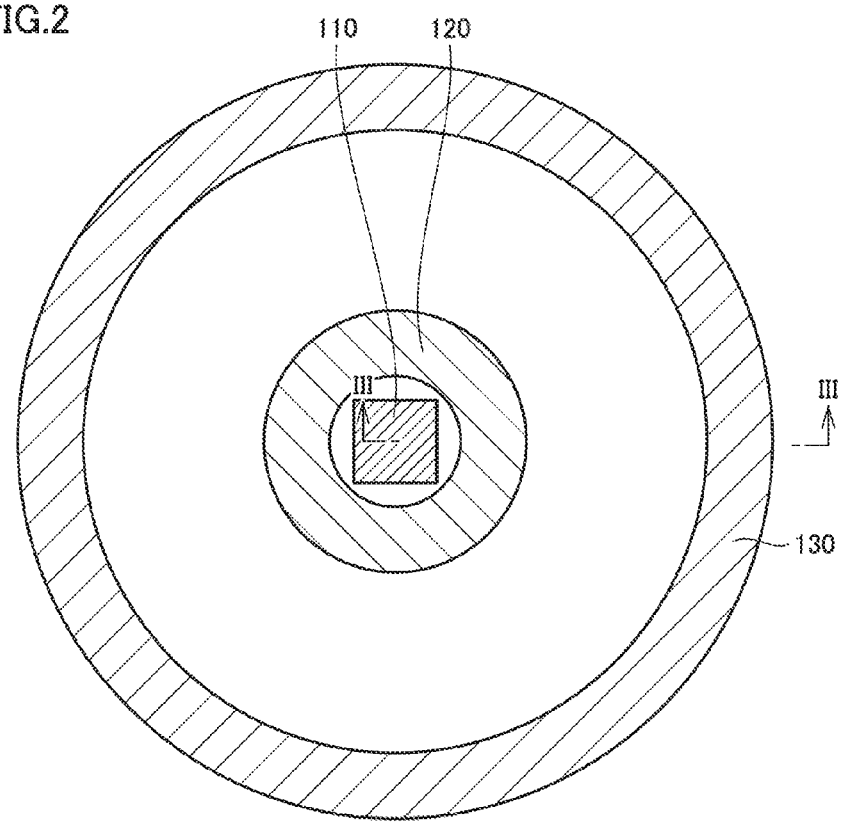
FIG. 2 is a cross-sectional view of the stationary induction apparatus according to the first embodiment of the present invention, as seen in a direction indicated in FIG. 1 by an arrow II-II.
Figure 3:
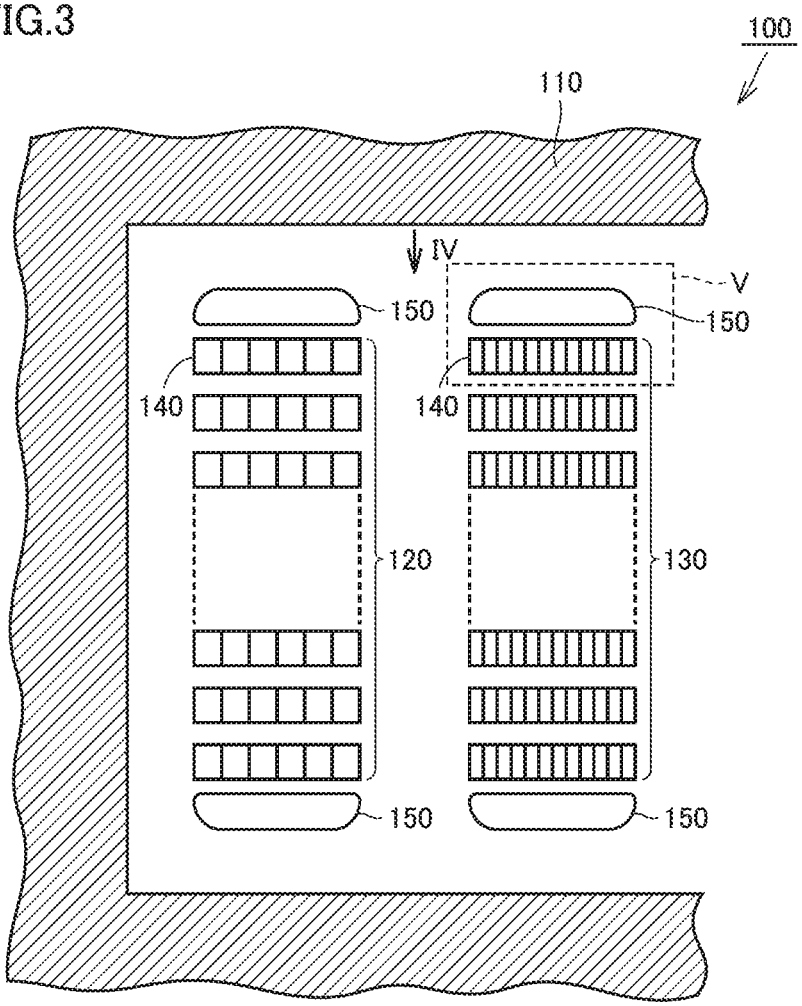
FIG. 3 is a cross-sectional view of the stationary induction apparatus according to the first embodiment of the present invention, as seen in a direction indicated in FIG. 2 by an arrow III-III.
Figure 4:
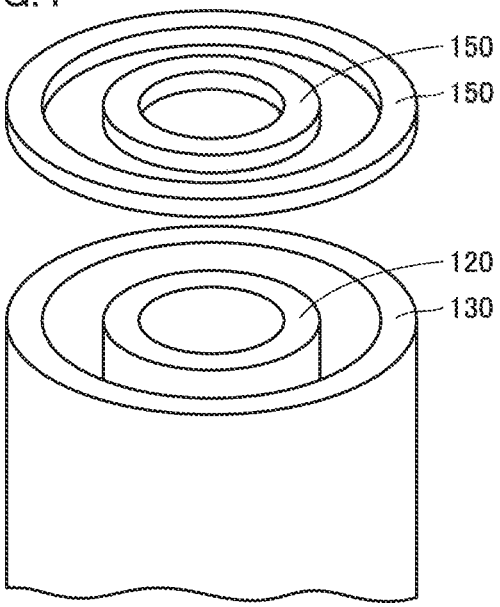
FIG. 4 is an exploded perspective view of the stationary induction apparatus according to the first embodiment of the present invention, as seen in a direction indicated in FIG. 3 by an arrow IV.
Figure 5:
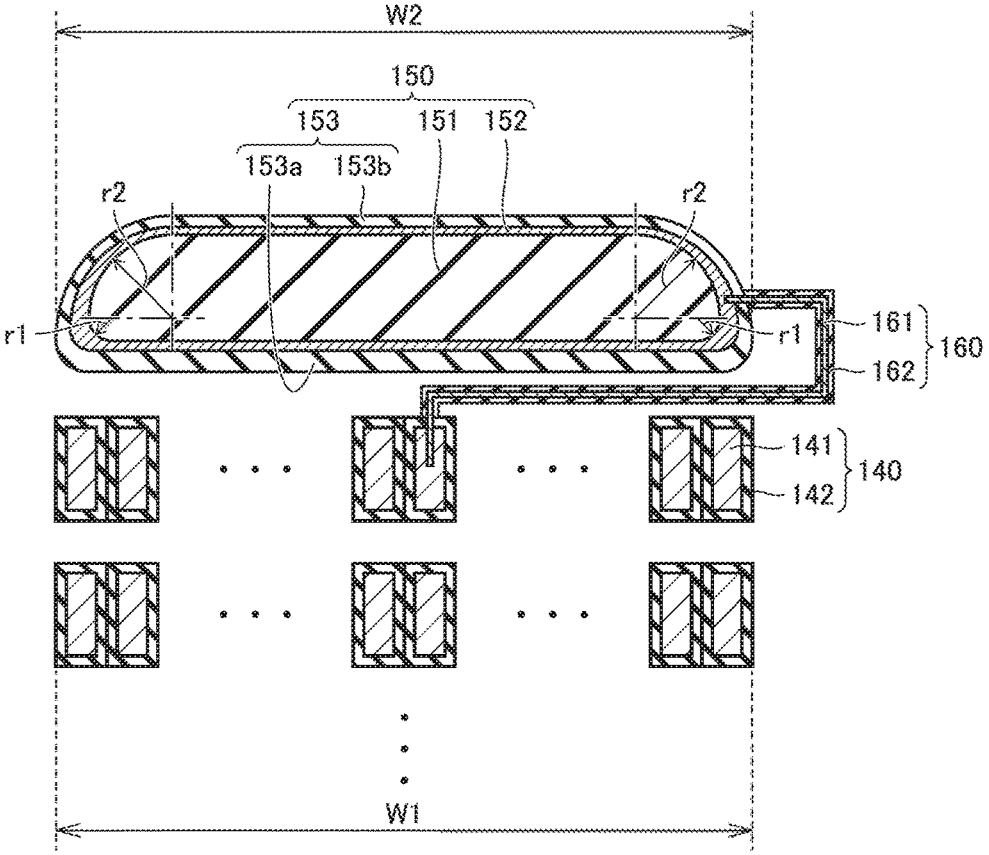
FIG. 5 is a cross-sectional view of the stationary induction apparatus according to the first embodiment of the present invention, showing a portion V of FIG. 3 in an enlarged view.

FIG. 1 is a perspective view showing an appearance of a stationary induction apparatus according to a first embodiment of the present invention. FIG. 2 is a cross-sectional view of the stationary induction apparatus according to the first embodiment of the present invention, as seen in a direction indicated in FIG. 1 by an arrow II-II. FIG. 3 is a cross-sectional view of the stationary induction apparatus according to the first embodiment of the present invention, as seen in a direction indicated in FIG. 2 by an arrow III-III. FIG. 4 is an exploded perspective view of the stationary induction apparatus according to the first embodiment of the present invention, as seen in a direction indicated in FIG. 3 by an arrow IV. FIG. 5 is a cross-sectional view of the stationary induction apparatus according to the first embodiment of the present invention, showing a portion V of FIG. 3 in an enlarged view. Note that FIG. 1 shows no electrostatic shields. FIG. 4 does not show a core.

As shown in FIGS. 1 to 5, a stationary induction apparatus 100 according to the first embodiment of the present invention is a core-type transformer. Stationary induction apparatus 100 includes a core 110, and a low-voltage winding 120 and a high-voltage winding 130 concentrically wound around a main leg of core 110 such that the main leg serves as the central axis. In other words, stationary induction apparatus 100 includes a plurality of windings.

Stationary induction apparatus 100 further includes a tank (not shown). The tank is filled with an insulating oil or an insulating gas that is an insulating medium and cooling medium. The insulating oil is mineral oil, ester oil, or silicone oil, for example. The insulating gas is $SF_6$ gas or dry air, for example. Core 110, low-voltage winding 120, and high-voltage winding 130 are housed in the tank.

High-voltage winding 130 is located outside low-voltage winding 120. High-voltage winding 130 is formed of a plurality of discal windings layered in a direction along the central axis. Each of the windings is formed of a flat-type electric wire 140 wound in a disc shape. Flat-type electric wire 140 includes an electric wire portion 141, which has a generally rectangular shape in a transverse cross section, and a first insulating coating 142, which coats electric wire portion 141. Although not shown, low-voltage winding 120 also has a configuration similar to that of high-voltage winding 130.

Stationary induction apparatus 100 further includes an annular electrostatic shield 150 disposed adjacent to an end of each of low-voltage winding 120 and high-voltage winding 130 as seen in a direction extending along the central axis. Note that while in the present embodiment electrostatic shield 150 is disposed adjacent to opposite ends of each of low-voltage winding 120 and high-voltage winding 130 in a one-to-one correspondence, electrostatic shield 150 is not limited as such and it is sufficient that electrostatic shield 150 is disposed adjacent to at least one of the ends of each of low-voltage winding 120 and high-voltage winding 130 in a one-to-one correspondence. Four electrostatic shields 150 that stationary induction apparatus 100 comprises are each installed to reduce an amplitude of potential oscillation and in addition, alleviate electric field concentration at an end of each of low voltage winding 120 and high voltage winding 130 as seen in the direction along the central axis.

Each of the four electrostatic shields 150 includes an insulator 151, a conductor 152, and a second insulating coating 153, which coats conductor 152. In the present embodiment, conductor 152 is provided so as to cover a surface of insulator 151. Alternatively, insulator 151 may be composed of conductor 152. In other words, electrostatic shield 150 may be composed of conductor 152 and second insulating coating 153.

Conductor 152 of each of the four electrostatic shields 150 is provided with a cut at one or more locations such that conductor 152 is discontinuous in its circumferential direction. This cut can prevent a current flowing to circulate around the entire circumference of electrostatic shield 150. While in the present embodiment insulator 151 of each of the four electrostatic shields 150 is not provided with a cut, insulator 151 may be provided with a cut at the same locations as conductor 152 is provided with a cut. In that case, conductor 152, as seen in the circumferential direction, has opposite ends coated with second insulating coating 153.

Insulator 151 is composed of press board or compressed wood. Compressed wood is wood with increased strength by compression molding or resin injection. Conductor 152 is composed of wire net, metal foil, conductive tape, or conductive paint. Second insulating coating 153 is composed of press board or polyethylene terephthalate.

To reduce the amplitude of potential oscillations, electrostatic shield 150 needs to follow variation in potential of low-voltage winding 120 or high-voltage winding 130 adjacent to electrostatic shield 150 when an impulse voltage enters stationary induction apparatus 100. If conductor 152 has a high electric resistivity, the potential of electrostatic shield 150 follows slowly and potential oscillation may be insufficiently suppressed. Accordingly, conductor 152 preferably has a surface resistivity of 10 Ω/sq or more and 50 Ω/sq or less.

Each of an end on an outer peripheral side and an end on an inner peripheral side of electrostatic shield 150 is formed as a curved surface. In the present embodiment, each of the end on the outer peripheral side and the end on the inner peripheral side of electrostatic shield 150 is formed as a curved surface with two contiguous arc portions having different curvature radii in a transverse cross section. Specifically, each of an end on an outer peripheral side and an end on an inner peripheral side of insulator 151 is formed as a curved surface in a transverse cross section such that the curved surface is composed of an arc portion having a curvature radius r1 and an arc portion having a curvature radius r2 that are contiguous to each other in the transverse cross section. Conductor 152 and second insulating coating 153 each have an external shape substantially similar to that of insulator 151.

Curvature radius r2 is larger than curvature radius r1. In electrostatic shield 150, the arc portion having curvature radius r1 is provided on a side closer to a winding adjacent to electrostatic shield 150, and the arc portion having curvature radius r2 is provided on a side opposite to the side closer to the winding adjacent to electrostatic shield 150.

In a radial direction orthogonal to the direction along the central axis, a width W2 of electrostatic shield 150 is equivalent to a width W1 of the winding adjacent to electrostatic shield 150. In other words, width W2 of electrostatic shield 150 adjacent to low-voltage winding 120 is equivalent to width W1 of low-voltage winding 120. Width W2 of electrostatic shield 150 adjacent to high-voltage winding 130 is equivalent to width W1 of high-voltage winding 130.

Width W1 of each of low-voltage winding 120 and high-voltage winding 130 is a width from an end on an inner peripheral side of first insulating coating 142 of flat type electric wire 140 located at an innermost periphery of the winding, toward a radially outer side of the central axis, to an end on an outer peripheral side of first insulating coating 142 of flat type electric wire 140 located at an outermost periphery of the winding. Width W2 of electrostatic shield 150 is a width from an external surface of second insulating coating 153 located at an end on an inner peripheral side of electrostatic shield 150, toward the radially outer side of the central axis, to an external surface of second insulating coating 153 located at an end on an outer peripheral side of electrostatic shield 150.

Being equivalent to width W1 of a winding means falling within a range of 90% to 110% of width W1 of the winding. A winding and electrostatic shield 150 having widths W1 and W2, respectively, equivalently, allow mitigation of electric field concentration at each of an end of the winding on the side of electrostatic shield 150 and an end of electrostatic shield 150 on the side of the winding, and hence allow stationary induction apparatus 100 to present enhanced insulation performance.

Second insulating coating 153 includes an inner portion 153*a* facing low-voltage winding 120 or high-voltage winding 130 adjacent thereto in the direction along the central axis, and an outer portion 153*b* located on a side opposite to low-voltage winding 120 or high-voltage winding 130 adjacent thereto in the direction along the central axis. Inner portion 153*a* is thicker than outer portion 153*b*. In second insulating coating 153, portions located between outer portion 153*b* and inner portion 153*a* and configuring the end on the outer peripheral side and the end on the inner peripheral side of electrostatic shield 150 have a thickness equal to or less than the thickness of inner portion 153*a* and equal to or larger than the thickness of outer portion 153*b*.

In the present embodiment, stationary induction apparatus 100 further comprises a wiring 160 electrically connecting conductor 152 of electrostatic shield 150 and electric wire portion 141 of an end of a winding adjacent to electrostatic shield 150. As shown in FIG. 5, wiring 160 is connected to electric wire portion 141 of the end of the winding adjacent to electrostatic shield 150 at a portion located between an innermost periphery of the winding and an outermost periphery of the winding. Wiring 160 is composed of a core wire 161 and a third insulating coating 162 coating core wire 161.

Specifically, conductor 152 of electrostatic shield 150 adjacent to low-voltage winding 120 is connected by wiring 160 to electric wire portion 141 of flat type electric wire 140 located at an end of low-voltage winding 120, that is located between an innermost periphery of the winding and an outermost periphery of the winding. As a result, conductor 152 of electrostatic shield 150 and electric wire portion 141 of flat type electric wire 140 located at the end of low-voltage winding 120, that is located between the innermost periphery of the winding and the outermost periphery of the winding are equipotential. Conductor 152 of electrostatic shield 150 adjacent to high-voltage winding 130 is connected by wiring 160 to electric wire portion 141 of flat type electric wire 140 located at an end of high-voltage winding 130, that is located between an innermost periphery of the winding and an outermost periphery of the winding. As a result, conductor 152 of electrostatic shield 150 and electric wire portion 141 of flat type electric wire 140 located at the end of high-voltage winding 130, that is located between the innermost periphery of the winding and the outermost periphery of the winding are equipotential.

Generally, electric wire portion 141 of flat type electric wire 140 located at an end of high-voltage winding 130, that is located at the innermost periphery of the winding or the outermost periphery of the winding will be an input end to which a highest voltage is applied among a plurality of windings that stationary induction apparatus 100 comprises. Normally, conductor 152 of electrostatic shield 150 adjacent to high-voltage winding 130 is connected to this input end to be equipotential.

Electric wire portion 141 of flat type electric wire 140 located at the end of high-voltage winding 130, that is located between the innermost periphery of the winding and the outermost periphery of the winding will have a potential lower than the highest potential in the plurality of windings that stationary induction apparatus 100 comprises. In stationary induction apparatus 100 according to the present embodiment, conductor 152 of electrostatic shield 150 is connected to electric wire portion 141 of an end of a winding adjacent to electrostatic shield 150 at a portion located between an innermost periphery of the winding and an outermost periphery of the winding. As a result, conductor 152 of electrostatic shield 150 has a potential which is equal to that of electric wire portion 141 of flat type electric wire 140 located at the end of high-voltage winding 130, that is located between the innermost periphery of the winding and the outermost periphery of the winding, and which is lower than the highest potential in the plurality of windings that stationary induction apparatus 100 comprises. Furthermore, the plurality of electrostatic shields 150 each have a potential lower than the highest potential in a winding adjacent thereto in a one-to-one correspondence.

As a result, in stationary induction apparatus 100 according to the present embodiment, a potential of electrostatic shield 150 relative to the ground can be lower than when conductor 152 of electrostatic shield 150 is connected to the input end. This can reduce an electric field at the end on the outer peripheral side and the end on the inner peripheral side of electrostatic shield 150. In stationary induction apparatus 100 according to the present embodiment, it is not necessary to increase the thickness of electrostatic shield 150. In other words, stationary induction apparatus 100 can mitigate electric field concentration at the end on the outer peripheral side and the end on the inner peripheral side of electrostatic shield 150 while restraining electrostatic shield 150 from thickening.

While, as shown in FIG. 5, in the present embodiment, wiring 160 is connected to an external surface of conductor 152 at an outer peripheral portion thereof, it is not limited as such, and wiring 160 may be connected to the external surface of conductor 152 at an inner peripheral portion thereof. In order to further ensure insulation performance between wiring 160 and a winding, it is preferable that conductor 152 be connected to wiring 160 at the external surface of conductor 152 at one of the inner peripheral portion and the outer peripheral portion thereof that has a smaller potential difference from an adjacent winding. For the same reason, it is preferable that wiring 160 be disposed along a surface of second insulating coating 153 of electrostatic shield 150.

When connecting wiring 160 to electrostatic shield 150, a portion of second insulating coating 153 of electrostatic shield 150 is removed to expose conductor 152, and core wire 161 is connected to the exposed portion of conductor 152 by soldering or silver brazing. This connection portion is covered with insulating paper. When connecting wiring 160 to a winding, a portion of first insulating coating 142 of flat type electric wire 140 is removed to expose electric wire portion 141, and core wire 161 is connected to the exposed portion of electric wire portion 141 by soldering or silver brazing. This connection portion is covered with insulating paper.

In stationary induction apparatus 100 according to the present embodiment, a relative dielectric constant of a material forming second insulating coating 153 is higher than a relative dielectric constant of a material forming an insulating medium, and an electrostatic capacitance between electrostatic shield 150 and a winding adjacent to electrostatic shield 150 can be increased. When an impulse voltage such as lightning surge enters stationary induction apparatus 100, a potential difference generated between adjacent electric wires in a winding adjacent to electrostatic shield 150 can be reduced, and as a result, an amplitude of potential oscillation can be reduced.

Furthermore, in second insulating coating 153 of electrostatic shield 150, inner portion 153*a* is thicker than outer portion 153*b*, and insulation between electrostatic shield 150 and a winding adjacent to electrostatic shield 150 can be enhanced. This allows stationary induction apparatus 100 to be more reliable in providing insulation.

Figure 6:
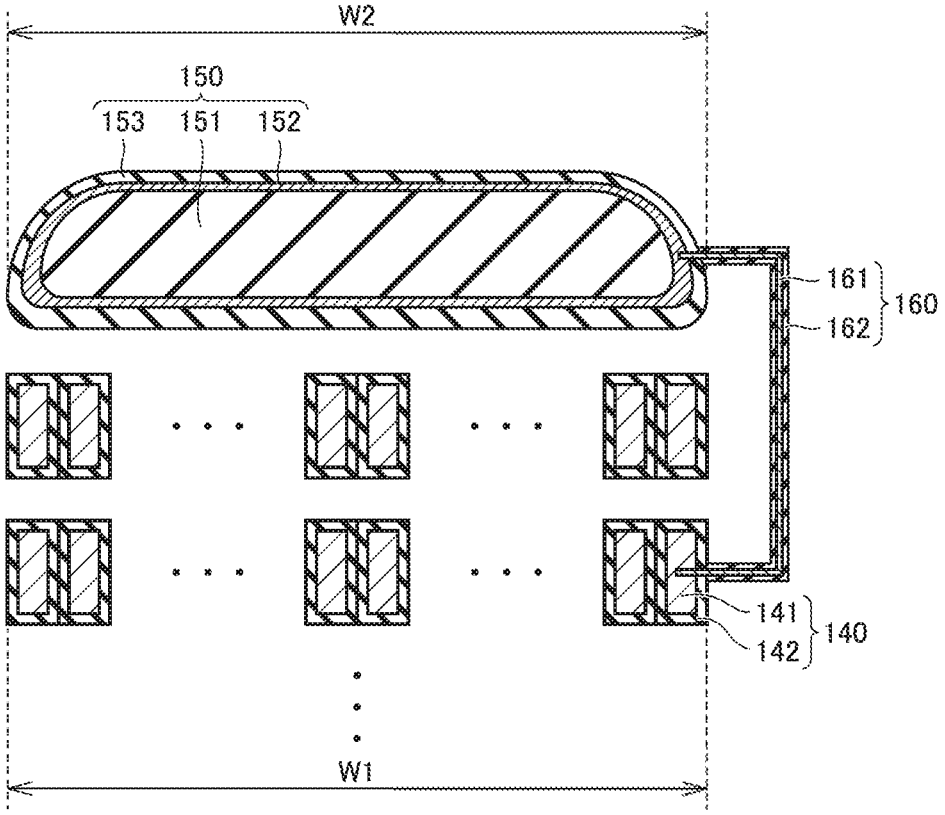
FIG. 6 is a cross-sectional view showing a manner of electrical connection of an electrostatic shield of a stationary induction apparatus according to a first exemplary variation of the first embodiment of the present invention.
Figure 7:
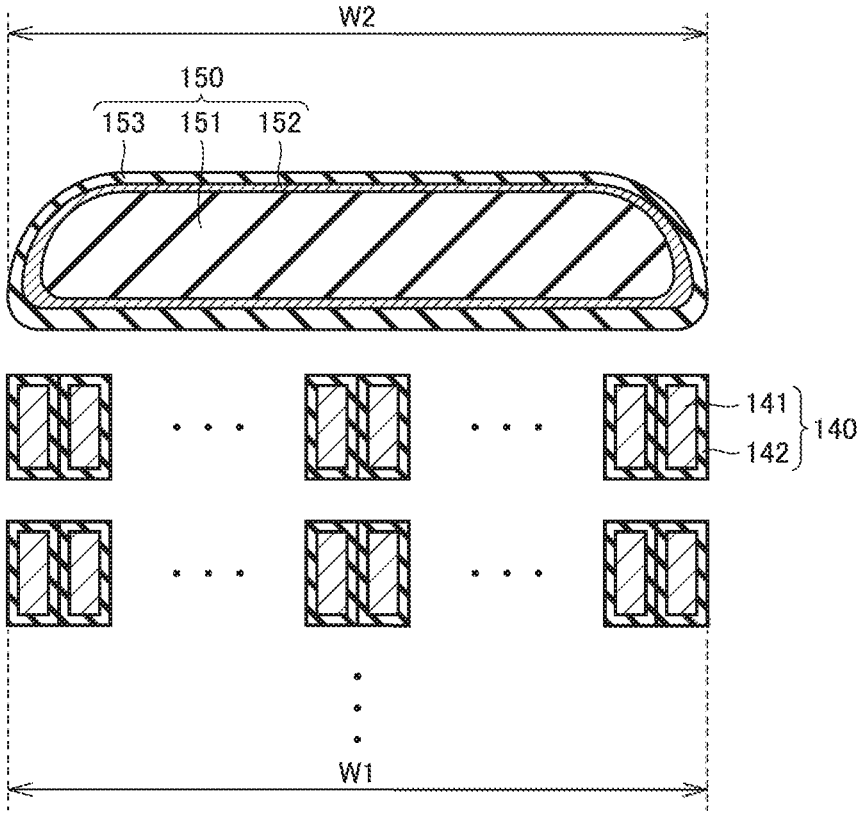
FIG. 7 is a cross-sectional view showing a manner of electrical connection of an electrostatic shield of a stationary induction apparatus according to a second exemplary variation of the first embodiment of the present invention.

Note that a manner of electrical connection for making the potential of electrostatic shield 150 lower than the potential of the input end is not limited to the above. An exemplary variation of a manner of electrical connection of an electrostatic shield will now be described. FIG. 6 is a cross-sectional view showing a manner of electrical connection of an electrostatic shield of a stationary induction apparatus according to a first exemplary variation of the first embodiment of the present invention. FIG. 7 is a cross-sectional view showing a manner of electrical connection of an electrostatic shield of a stationary induction apparatus according to a second exemplary variation of the first embodiment of the present invention. FIGS. 6 and 7 are shown in the same cross section as FIG. 5.

As shown in FIG. 6, conductor 152 of electrostatic shield 150 of the stationary induction apparatus according to the first exemplary variation of the first embodiment of the present invention is electrically connected to electric wire portion 141 excluding the end of a winding adjacent to electrostatic shield 150. As a result, conductor 152 of electrostatic shield 150 is equal in potential to electric wire portion 141 excluding the end of the winding adjacent to electrostatic shield 150. Electric wire portion 141 excluding the end of the winding adjacent to electrostatic shield 150 will have a potential lower than the highest potential in the plurality of windings that the stationary induction apparatus according to the first exemplary variation comprises.

As a result, in the stationary induction apparatus according to the first exemplary variation, a potential of electrostatic shield 150 relative to the ground can be lower than when conductor 152 of electrostatic shield 150 is connected to the input end. This can reduce an electric field at the end on the outer peripheral side and the end on the inner peripheral side of electrostatic shield 150. The stationary induction apparatus according to the first exemplary variation also does not require electrostatic shield 150 to be increased in thickness. In other words, the stationary induction apparatus in the first exemplary variation can also mitigate electric field concentration at the end on the outer peripheral side and the end on the inner peripheral side of electrostatic shield 150 while restraining electrostatic shield 150 from thickening.

In the stationary induction apparatus according to the first exemplary variation, conductor 152 of electrostatic shield 150 may be connected to a winding adjacent to electrostatic shield 150 at a portion excluding an end of the winding and located at one of an innermost periphery of the winding and an outermost periphery of the winding.

That is, conductor 152 of electrostatic shield 150 adjacent to low-voltage winding 120 is connected by wiring 160 to electric wire portion 141 of flat type electric wire 140 located at a portion of low-voltage winding 120 excluding an end of the winding and located at an innermost periphery of the winding or an outermost periphery of the winding, and conductor 152 of electrostatic shield 150 and electric wire portion 141 of flat type electric wire 140 located at the portion of low-voltage winding 120 excluding the end of low-voltage winding 120 and located at the innermost periphery of the winding or the outermost periphery of the winding may be equipotential. Conductor 152 of electrostatic shield 150 adjacent to high-voltage winding 130 is connected by wiring 160 to electric wire portion 141 of flat type electric wire 140 located at a portion of high-voltage winding 130 excluding an end of high-voltage winding 130 and located at an innermost periphery of the winding or an outermost periphery of the winding, and conductor 152 of electrostatic shield 150 and electric wire portion 141 of flat type electric wire 140 located at the portion of high-voltage winding 130 excluding the end of high-voltage winding 130 and located at the innermost periphery of the winding or the outermost periphery of the winding may be equipotential. In that case, wiring 160 and electric wire portion 141 can be easily connected, and the stationary induction apparatus according to the first exemplary variation can be assembled more easily than stationary induction apparatus 100 according to the first embodiment.

As shown in FIG. 7, conductor 152 of electrostatic shield 150 of the stationary induction apparatus according to the second exemplary variation of the first embodiment of the present invention is electrically floating. That is, the stationary induction apparatus according to the second exemplary variation does not comprise wiring 160, and conductor 152 of electrostatic shield 150 is not electrically connected to electric wire portion 141 of a winding.

Conductor 152 of electrostatic shield 150 of the stationary induction apparatus according to the second exemplary variation of the first embodiment of the present invention has a potential relative to the ground determined by a positional relationship between electrostatic shield 150, and a winding and iron core 110 adjacent to electrostatic shield 150. That is, by their positional relationship, an electrostatic capacitance between electrostatic shield 150 and the winding adjacent to electrostatic shield 150 is defined, and by the defined electrostatic capacitance, a potential of conductor 152 of electrostatic shield 150 relative to the ground is determined.

The stationary induction apparatus according to the second exemplary variation also allows a potential of electrostatic shield 150 relative to the ground to be lower than when conductor 152 of electrostatic shield 150 is connected to the input end. This can reduce an electric field at the end on the outer peripheral side and the end on the inner peripheral side of electrostatic shield 150. The stationary induction apparatus according to the second exemplary variation also does not require electrostatic shield 150 to be increased in thickness. In other words, the stationary induction apparatus in the second exemplary variation can also mitigate electric field concentration at the end on the outer peripheral side and the end on the inner peripheral side of electrostatic shield 150 while restraining electrostatic shield 150 from thickening.

Second Embodiment

A stationary induction apparatus according to a second embodiment of the present invention will be described hereinafter. The stationary induction apparatus according to the present embodiment differs from the stationary induction apparatus according to the first embodiment mainly in that the former is a shell-type transformer, and accordingly, the description of any configuration similar to that of the stationary induction apparatus according to the first embodiment will not be repeated.

Figure 8:
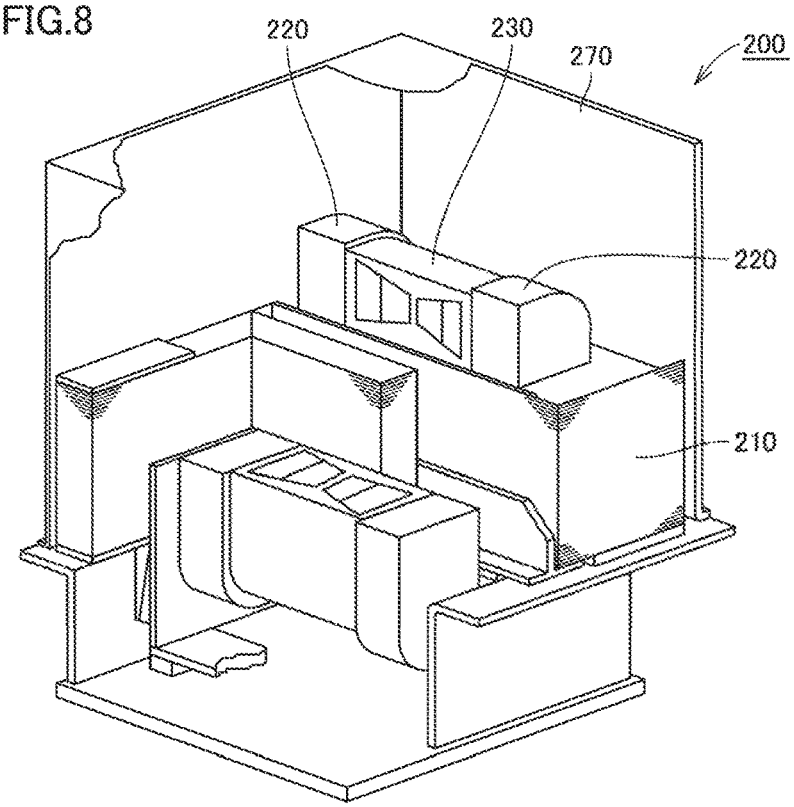
FIG. 8 is a perspective view showing an appearance of a stationary induction apparatus according to a second embodiment of the present invention.
Figure 9:
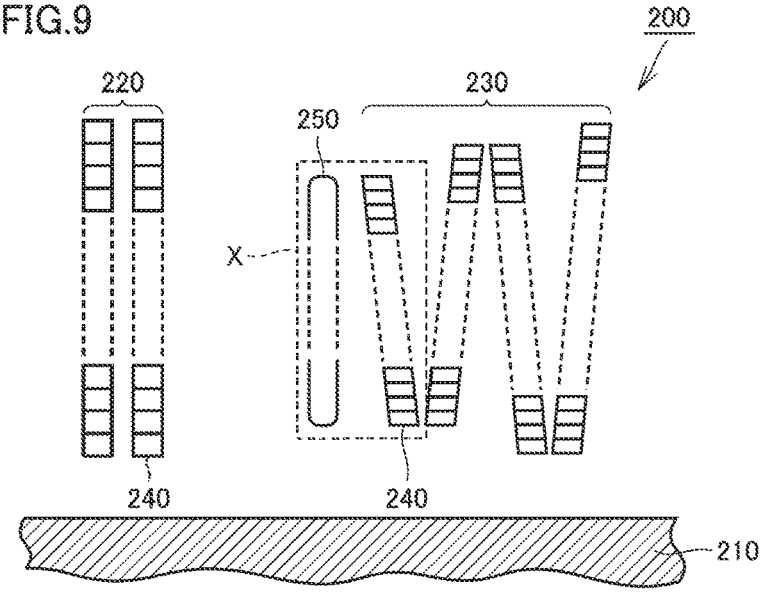
FIG. 9 is a partial cross-sectional view of the stationary induction apparatus according to the second embodiment of the present invention.
Figure 10:
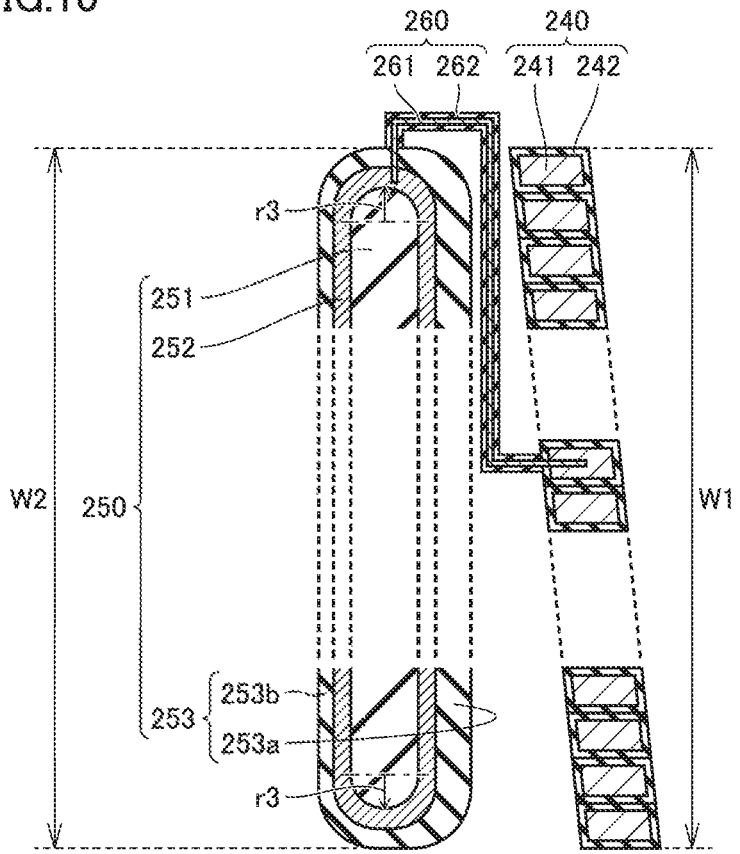
FIG. 10 is a cross-sectional view of the stationary induction apparatus according to the second embodiment of the present invention, showing a portion X of FIG. 9 in an enlarged view.

FIG. 8 is a perspective view showing an appearance of a stationary induction apparatus according to the second embodiment of the present invention. FIG. 9 is a partial cross-sectional view of the stationary induction apparatus according to the second embodiment of the present invention. FIG. 10 is a cross-sectional view of the stationary induction apparatus according to the second embodiment of the present invention, showing a portion X of FIG. 9 in an enlarged view. Note that FIG. 8 shows no electrostatic shields. FIG. 9 shows only a portion above a core.

As shown in FIGS. 8-10, a stationary induction apparatus 200 according to the second embodiment of the present invention is a shell-type transformer. Stationary induction apparatus 200 includes a core 210, and a low-voltage winding 220 and a high-voltage winding 230 wound around a main leg of core 210 to be coaxially disposed such that the main leg serves as the central axis.

Stationary induction apparatus 200 further includes a tank 270. Tank 270 is filled with an insulating oil or an insulating gas that is an insulating medium and cooling medium. The insulating oil is mineral oil, ester oil, or silicone oil, for example. The insulating gas is $SF_6$ gas or dry air, for example. Core 210, low-voltage windings 220, and high-voltage winding 230 are housed in tank 270.

In a direction along the central axis, high-voltage winding 230 is disposed so as to be sandwiched between low-voltage windings 220. High-voltage winding 230 is formed of a plurality of unit windings layered in the axial direction of the central axis. Each of the windings is formed of a flat-type electric wire 240 wound in the form of a race track. Flat-type electric wire 240 includes an electric wire portion 241, which has a generally rectangular shape in a transverse cross section, and a first insulating coating 242, which coats electric wire portion 241. Although not shown, low-voltage winding 220 also has a configuration similar to that of high-voltage winding 230.

Stationary induction apparatus 200 further includes a plurality of annular electrostatic shields 250 disposed adjacent to the respective ends of low-voltage winding 220 and high-voltage winding 230 in the direction extending along the central axis. It should be noted that FIG. 9 shows only one electrostatic shield 250 adjacent to high-voltage winding 230.

Each of the four electrostatic shields 250 includes an insulator 251, a conductor 252, and a second insulating coating 253 which coats conductor 252. In the present embodiment, conductor 252 is provided so as to cover a surface of insulator 251. Alternatively, insulator 251 may be composed of conductor 252. In other words, electrostatic shield 250 may be composed of conductor 252 and second insulating coating 253.

Conductor 252 of each of the four electrostatic shields 250 is provided with a cut at one or more locations such that conductor 252 is discontinuous in its circumferential direction. This cut can prevent a current flowing to circulate around the entire circumference of electrostatic shield 250. While in the present embodiment insulator 251 of each of the four electrostatic shields 250 is not provided with a cut, insulator 251 may be provided with a cut at the same locations as conductor 252 is provided with a cut. In that case, conductor 252, as seen in the circumferential direction, has opposite ends coated with second insulating coating 253.

Insulator 251 is composed of press board or compressed wood. Conductor 252 is composed of wire net, metal foil, conductive tape, or conductive paint. Second insulating coating 253 is composed of press board or polyethylene terephthalate.

To reduce the amplitude of potential oscillations, electrostatic shield 250 needs to follow variation in potential of low-voltage winding 220 or high-voltage winding 230 adjacent to electrostatic shield 250 when an impulse voltage enters stationary induction apparatus 200. If conductor 252 has a high electric resistivity, the potential of electrostatic shield 250 follows slowly and potential oscillation may be insufficiently suppressed. Accordingly, conductor 252 preferably has a surface resistivity of 10 Ω/sq or more and 50 Ω/sq or less.

Each of an end on an outer peripheral side and an end on an inner peripheral side of electrostatic shield 250 is formed as a curved surface. In the present embodiment, each of the end on the outer peripheral side and the end on the inner peripheral side of electrostatic shield 250 is formed as a curved surface semicircular in a transverse cross section. Specifically, each of an end on an outer peripheral side and an end on an inner peripheral side of insulator 251 is formed as a curved surface that has a radius r3 and is semicircular in a transverse cross section, and conductor 252 and second insulating coating 253 each have an external shape substantially similar to that of insulator 251.

In a radial direction of the central axis, width W2 of electrostatic shield 250 is equivalent to width W1 of a winding adjacent to electrostatic shield 250. In other words, width W2 of electrostatic shield 250 adjacent to low-voltage winding 220 is equivalent to width W1 of low-voltage winding 220. Width W2 of electrostatic shield 250 adjacent to high-voltage winding 230 is equivalent to width W1 of high-voltage winding 230.

Width W1 of each of low-voltage winding 220 and high-voltage winding 230 is a width from an end on an inner peripheral side of first insulating coating 242 of flat type electric wire 240 located at an innermost periphery of the winding, toward a radially outer side of the central axis, to an end on an outer peripheral side of first insulating coating 242 of flat type electric wire 240 located at an outermost periphery of the winding. Width W2 of electrostatic shield 250 is a width from an external surface of second insulating coating 253 located at an end on an inner peripheral side of electrostatic shield 250, toward the radially outer side of the central axis, to an external surface of second insulating coating 253 located at an end on an outer peripheral side of electrostatic shield 250.

Being equivalent to width W1 of a winding means falling within a range of 90% to 110% of width W1 of the winding. A winding and electrostatic shield 250 having widths W1 and W2, respectively, equivalently, allow mitigation of electric field concentration at each of an end of the winding on the side of electrostatic shield 250 and an end of electrostatic shield 250 on the side of the winding, and hence allow stationary induction apparatus 200 to present enhanced insulation performance.

Second insulating coating 253 includes an inner portion 253*a* facing low-voltage winding 220 or high-voltage winding 230 adjacent thereto in the direction along the central axis, and an outer portion 253*b* located on a side opposite to low-voltage winding 220 or high-voltage winding 230 adjacent thereto in the direction along the central axis. Inner portion 253*a* is thicker than outer portion 253*b*. In second insulating coating 253, portions located between outer portion 253*b* and inner portion 253*a* and configuring the end on the outer peripheral side and the end on the inner peripheral side of electrostatic shield 250 have a thickness equal to or less than the thickness of inner portion 253*a* and equal to or larger than the thickness of outer portion 253*b*.

In the present embodiment, stationary induction apparatus 200 further comprises a wiring 260 electrically connecting conductor 252 of electrostatic shield 250 and electric wire portion 241 of an end of a winding adjacent to electrostatic shield 250. As shown in FIG. 10, wiring 260 is connected to electric wire portion 241 of the end of the winding adjacent to electrostatic shield 250 at a portion located between an innermost periphery of the winding and an outermost periphery of the winding. Wiring 260 is composed of a core wire 261 and a third insulating coating 262 coating core wire 261.

Specifically, conductor 252 of electrostatic shield 250 adjacent to low-voltage winding 220 is connected by wiring 260 to electric wire portion 241 of flat type electric wire 240 located at an end of low-voltage winding 220, that is located between an innermost periphery of the winding and an outermost periphery of the winding. As a result, conductor 252 of electrostatic shield 250 and electric wire portion 241 of flat type electric wire 240 located at the end of low-voltage winding 220, that is located between the innermost periphery of the winding and the outermost periphery of the winding are equipotential. Conductor 252 of electrostatic shield 250 adjacent to high-voltage winding 230 is connected by wiring 260 to electric wire portion 241 of flat type electric wire 240 located at an end of high-voltage winding 230, that is located between an innermost periphery of the winding and an outermost periphery of the winding. As a result, conductor 252 of electrostatic shield 250 and electric wire portion 241 of flat type electric wire 240 located at the end of high-voltage winding 230, that is located between the innermost periphery of the winding and the outermost periphery of the winding are equipotential.

Generally, electric wire portion 241 of flat type electric wire 240 located at an end of high-voltage winding 230, that is located at the innermost periphery of the winding or the outermost periphery of the winding will be an input end to which a highest voltage is applied among a plurality of windings that stationary induction apparatus 200 comprises. Normally, conductor 252 of electrostatic shield 250 adjacent to high-voltage winding 230 is connected to this input, and conductor 252 of electrostatic shield 250 and electric wire portion 241 of flat type electric wire 240 located at the end of high-voltage winding 230, that is located at the innermost periphery of the winding or the outermost periphery of the winding are equipotential.

Electric wire portion 241 of flat type electric wire 240 located at the end of high-voltage winding 230, that is located between the innermost periphery of the winding and the outermost periphery of the winding will have a potential lower than the highest potential in the plurality of windings that stationary induction apparatus 200 comprises. In stationary induction apparatus 200 according to the present embodiment, conductor 252 of electrostatic shield 250 is connected to electric wire portion 241 of an end of a winding adjacent to electrostatic shield 250 at a portion located between an innermost periphery of the winding and an outermost periphery of the winding, and conductor 252 of electrostatic shield 250 and electric wire portion 241 of the end of the winding adjacent to electrostatic shield 250 at the portion located between the innermost periphery of the winding and the outermost periphery of the winding are equipotential and have a potential lower than the highest potential in the plurality of windings that stationary induction apparatus 200 comprises. Furthermore, the plurality of electrostatic shields 250 each have a potential lower than the highest potential in a winding adjacent thereto in a one-to-one correspondence.

As a result, in stationary induction apparatus 200 according to the present embodiment, a potential of electrostatic shield 250 relative to the ground can be lower than when conductor 252 of electrostatic shield 250 is connected to the input end. This can reduce an electric field at the end on the outer peripheral side and the end on the inner peripheral side of electrostatic shield 250. In stationary induction apparatus 200 according to the present embodiment, it is not necessary to increase the thickness of electrostatic shield 250. In other words, stationary induction apparatus 200 can mitigate electric field concentration at the end on the outer peripheral side and the end on the inner peripheral side of electrostatic shield 250 while restraining electrostatic shield 250 from thickening.

While, as shown in FIG. 10, in the present embodiment, wiring 260 is connected to an external surface of conductor 252 at an outer peripheral portion thereof, it is not limited as such, and wiring 260 may be connected to the external surface of conductor 252 at an inner peripheral portion thereof. In order to further ensure insulation performance between wiring 260 and a winding, it is preferable that conductor 252 be connected to wiring 260 at the external surface of conductor 252 at one of the inner peripheral portion and the outer peripheral portion thereof that has a smaller potential difference from an adjacent winding. For the same reason, it is preferable that wiring 260 be disposed along a surface of second insulating coating 253 of electrostatic shield 250.

When connecting wiring 260 to electrostatic shield 250, a portion of second insulating coating 253 of electrostatic shield 250 is removed to expose conductor 252, and core wire 261 is connected to the exposed portion of conductor 252 by soldering or silver brazing. This connection portion is covered with insulating paper. When connecting wiring 260 to a winding, a portion of first insulating coating 242 of flat type electric wire 240 is removed to expose electric wire portion 241, and core wire 261 is connected to the exposed portion of electric wire portion 241 by soldering or silver brazing. This connection portion is covered with insulating paper.

In stationary induction apparatus 200 according to the present embodiment, a relative dielectric constant of a material forming second insulating coating 253 is higher than a relative dielectric constant of a material forming an insulating medium, and an electrostatic capacitance between electrostatic shield 250 and a winding adjacent to electrostatic shield 250 can be increased. When an impulse voltage such as lightning surge enters stationary induction apparatus 200, a potential difference generated between adjacent electric wires in a winding adjacent to electrostatic shield 250 can be reduced, and as a result, an amplitude of potential oscillation can be reduced.

Furthermore, in second insulating coating 253 of electrostatic shield 250, inner portion 253*a* is thicker than outer portion 253*b*, and insulation between electrostatic shield 250 and a winding adjacent to electrostatic shield 250 can be enhanced. This allows stationary induction apparatus 200 to be more reliable in providing insulation.

Note that a manner of electrically connecting electrostatic shield 250 is not limited to the above and may be similar to that described in the first or second exemplary variation of the first embodiment.

Third Embodiment

A stationary induction apparatus according to a third embodiment of the present invention will be described hereinafter. The stationary induction apparatus according to the present embodiment differs from the stationary induction apparatus according to the first embodiment mainly in that the former is a core-type reactor, and accordingly, the description of any configuration similar to that of the stationary induction apparatus according to the first embodiment will not be repeated.

Figure 11:
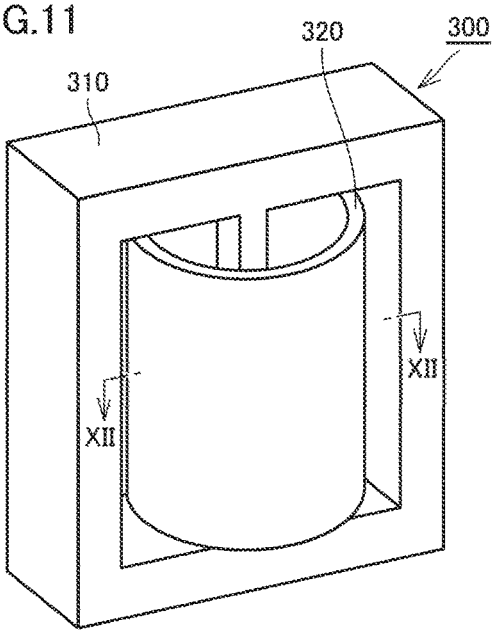
FIG. 11 is a perspective view showing an appearance of a stationary induction apparatus according to a third embodiment of the present invention.
Figure 12:
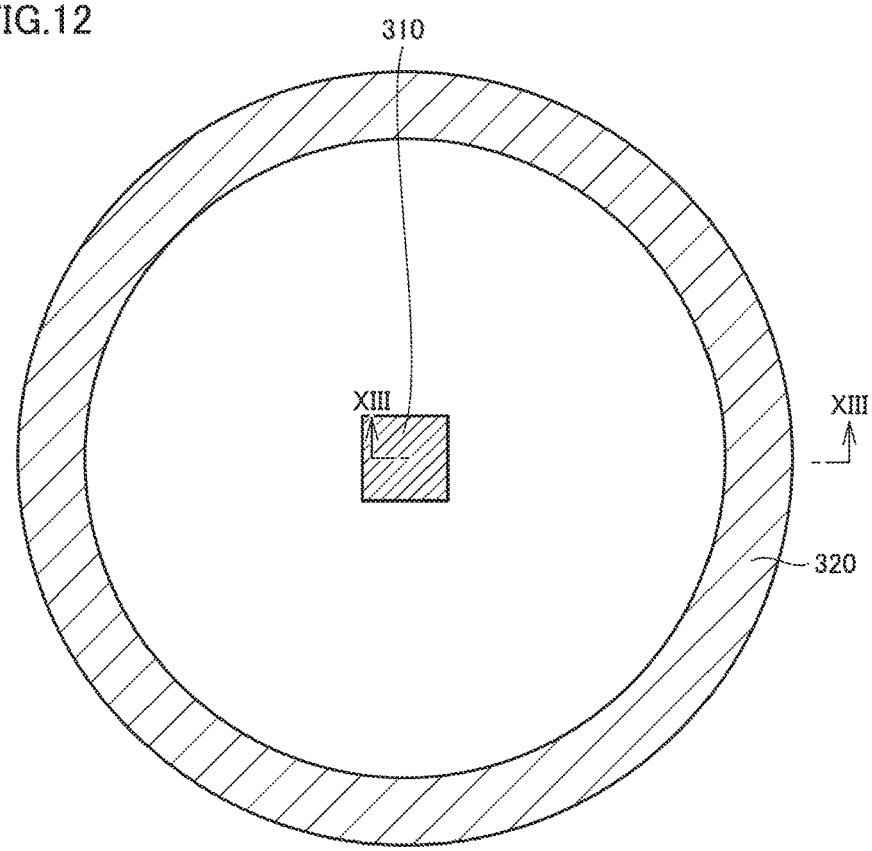
FIG. 12 is a cross-sectional view of the stationary induction apparatus according to the third embodiment of the present invention, as seen in a direction indicated in FIG. 11 by an arrow XII-XII.
Figure 13:
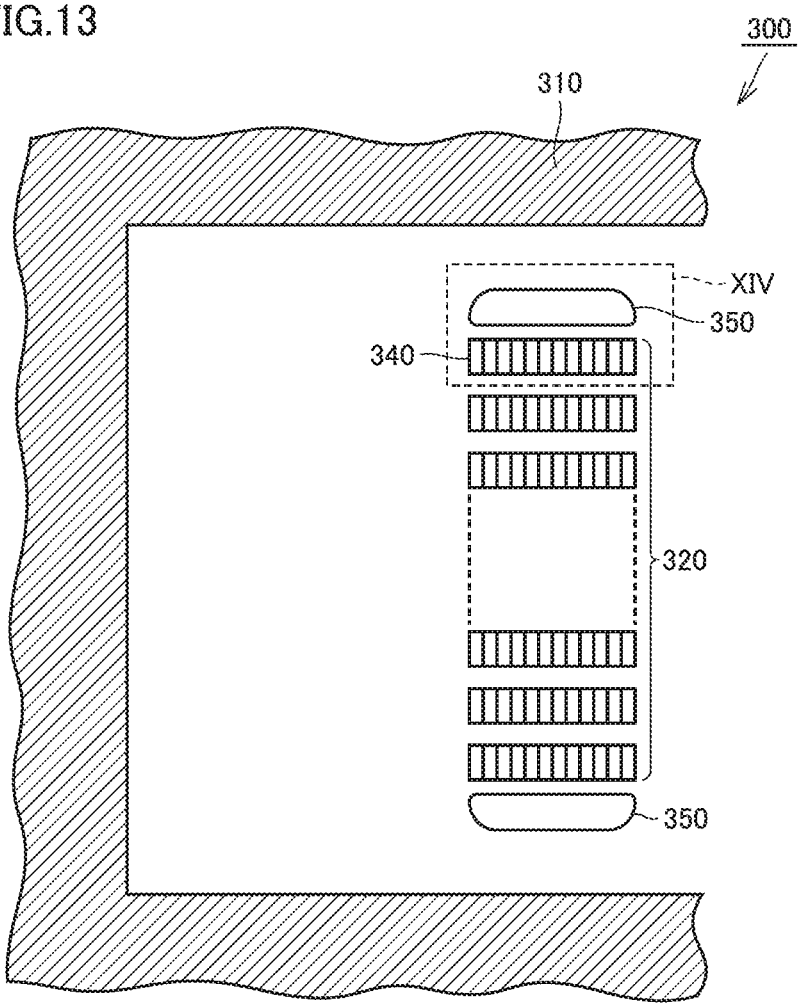
FIG. 13 is a cross-sectional view of the stationary induction apparatus according to the third embodiment of the present invention, as seen in a direction indicated in FIG. 12 by an arrow XIII-XIII.
Figure 14:
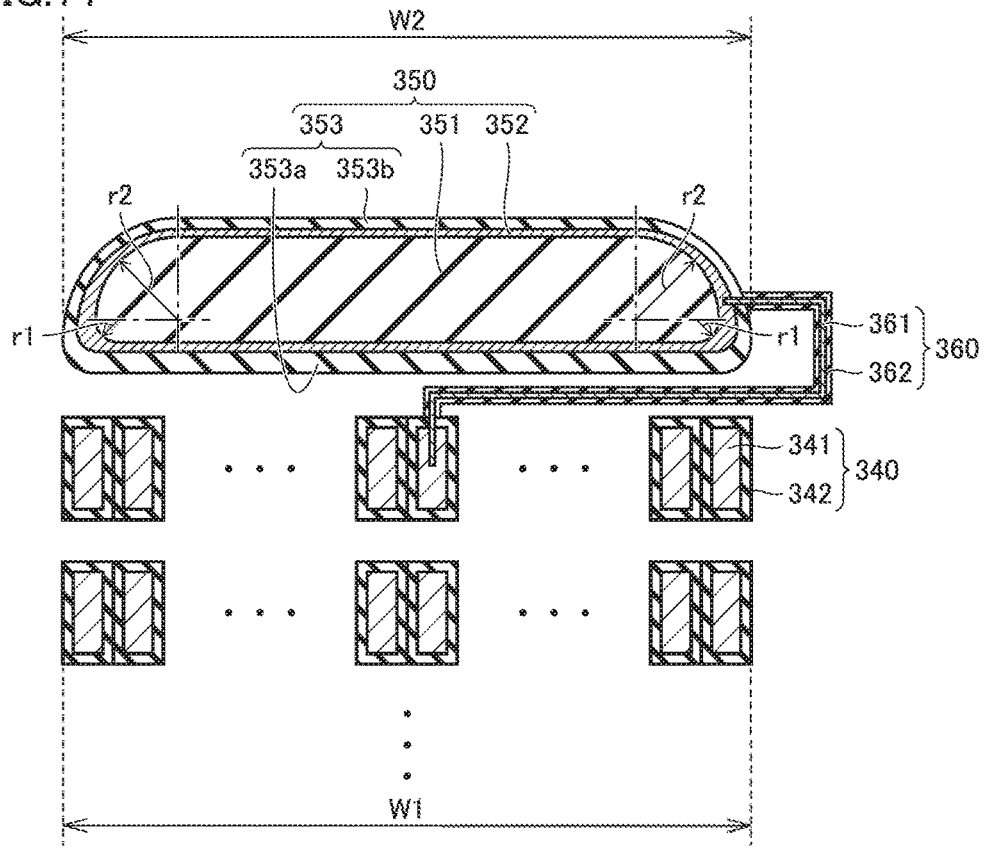
FIG. 14 is a cross-sectional view of the stationary induction apparatus according to the third embodiment of the present invention, showing a portion XIV of FIG. 13 in an enlarged view.

FIG. 11 is a perspective view showing an appearance of a stationary induction apparatus according to the third embodiment of the present invention. FIG. 12 is a cross-sectional view of the stationary induction apparatus according to the third embodiment of the present invention, as seen in a direction indicated in FIG. 11 by an arrow XII-XII. FIG. 13 is a cross-sectional view of the stationary induction apparatus according to the third embodiment of the present invention, as seen in a direction indicated in FIG. 12 by an arrow XIII-XIII. FIG. 14 is a cross-sectional view of the stationary induction apparatus according to the third embodiment of the present invention, showing a portion XIV of FIG. 13 in an enlarged view. Note that FIG. 11 shows no electrostatic shields.

As shown in FIGS. 11 to 14, a stationary induction apparatus 300 according to the third embodiment of the present invention is a core-type reactor. Stationary induction apparatus 300 includes a core 310, and a winding 320 concentrically wound around a main leg of core 310 such that the main leg serves as the central axis. In other words, stationary induction apparatus 300 includes a single winding.

Winding 320 is formed of a plurality of discal windings layered in a direction along the central axis. Each of the windings is formed of a flat-type electric wire 340 wound in a disc shape. Flat-type electric wire 340 includes an electric wire portion 341 substantially rectangular in transverse cross section and a first insulating coating 342 that coats electric wire portion 341.

Stationary induction apparatus 300 further includes an annular electrostatic shield 350 disposed adjacent to an end of winding 320 in a direction extending along the central axis. Note that while in the present embodiment electrostatic shield 350 is disposed adjacent to opposite ends of winding 320 in a one-to-one correspondence, electrostatic shield 350 is not limited as such and it is sufficient that electrostatic shield 350 is disposed adjacent to at least one of the ends of winding 320. Two electrostatic shields 350 which stationary induction apparatus 300 comprises are each installed to reduce an amplitude of potential oscillation and in addition, alleviate electric field concentration at an end of winding 320 in the direction along the central axis.

Two electrostatic shields 350 each include an insulator 351, a conductor 352, and a second insulating coating 353 that coats conductor 352. In the present embodiment, conductor 352 is provided so as to cover a surface of insulator 351. Alternatively, insulator 351 may be formed of conductor 352. In other words, electrostatic shield 350 may be formed of conductor 352 and second insulating coating 353.

Conductor 352 of each of the two electrostatic shields 350 is provided with a cut at one or more locations such that conductor 352 is discontinuous in its circumferential direction. This cut can prevent a current flowing to circulate around the entire circumference of electrostatic shield 350. While in the present embodiment insulator 351 of each of the two electrostatic shields 350 is not provided with a cut, insulator 351 may be provided with a cut at the same locations as conductor 352 is provided with a cut. In that case, conductor 352, as seen in the circumferential direction, has opposite ends coated with second insulating coating 353.

Each of an end on an outer peripheral side and an end on an inner peripheral side of electrostatic shield 350 is formed as a curved surface. In the present embodiment, each of the end on the outer peripheral side and the end on the inner peripheral side of electrostatic shield 350 is formed as a curved surface with two contiguous arc portions having different curvature radii in a transverse cross section. Specifically, each of an end on an outer peripheral side and an end on an inner peripheral side of insulator 351 is formed as a curved surface in a transverse cross section such that the curved surface is composed of an arc portion having a curvature radius r1 and an arc portion having a curvature radius r2 that are contiguous to each other in the transverse cross section. Conductor 352 and second insulating coating 353 each have an external shape substantially similar to that of insulator 351.

Curvature radius r2 is larger than curvature radius r1. In electrostatic shield 350, the arc portion having curvature radius r1 is provided on a side closer to a winding adjacent to electrostatic shield 350, and the arc portion having curvature radius r2 is provided on a side opposite to the side closer to the winding adjacent to electrostatic shield 350.

In a radial direction orthogonal to the direction along the central axis, width W2 of electrostatic shield 350 is equivalent to width W1 of winding 320 adjacent to electrostatic shield 350. Width W1 of winding 320 is a width from an end on an inner peripheral side of first insulating coating 342 of flat type electric wire 340 located at an innermost periphery of the winding, toward a radially outer side of the central axis, to an end on an outer peripheral side of first insulating coating 342 of flat type electric wire 340 located at an outermost periphery of the winding. Width W2 of electrostatic shield 350 is a width from an external surface of second insulating coating 353 located at an end on an inner peripheral side of electrostatic shield 350, toward the radially outer side of the central axis, to an external surface of second insulating coating 353 located at an end on an outer peripheral side of electrostatic shield 350.

Being equivalent to width W1 of winding 320 means falling within a range of 90% to 110% of width W1 of winding 320. Winding 320 and electrostatic shield 350 having widths W1 and W2, respectively, equivalently, allow mitigation of electric field concentration at each of an end of winding 320 on the side of electrostatic shield 350 and an end of electrostatic shield 350 on the side of winding 320, and hence allow stationary induction apparatus 300 to present enhanced insulation performance.

Second insulating coating 353 includes an inner portion 353*a* facing winding 320 adjacent thereto in the direction along the central axis, and an outer portion 353*b* located on a side opposite to winding 320 adjacent thereto in the direction along the central axis. Inner portion 353*a* is thicker than outer portion 353*b*. In second insulating coating 353, portions located between outer portion 353*b* and inner portion 353*a* and configuring the end on the outer peripheral side and the end on the inner peripheral side of electrostatic shield 350 have a thickness equal to or less than the thickness of inner portion 353*a* and equal to or larger than the thickness of outer portion 353*b*.

In the present embodiment, stationary induction apparatus 300 further comprises a wiring 360 electrically connecting conductor 352 of electrostatic shield 350 and electric wire portion 341 of an end of winding 320 adjacent to electrostatic shield 350. As shown in FIG. 14, wiring 360 is connected to electric wire portion 341 of the end of winding 320 adjacent to electrostatic shield 350 at a portion located between an innermost periphery of the winding and an outermost periphery of the winding. Wiring 360 is composed of a core wire 361 and a third insulating coating 362 coating core wire 361.

Specifically, conductor 352 of electrostatic shield 350 adjacent to winding 320 is connected by wiring 360 to electric wire portion 341 of flat type electric wire 340 located at an end of winding 320, that is located between an innermost periphery of the winding and an outermost periphery of the winding. As a result, conductor 352 of electrostatic shield 350 and electric wire portion 341 of flat type electric wire 340 located at the end of winding 320, that is located between the innermost periphery of the winding and the outermost periphery of the winding are equipotential.

Electric wire portion 341 of flat type electric wire 340 located at the end of winding 320, that is located between the innermost periphery of the winding and the outermost periphery of the winding will have a potential lower than the highest potential in the plurality of windings that stationary induction apparatus 300 comprises. In stationary induction apparatus 300 according to the present embodiment, conductor 352 of electrostatic shield 350 is connected to electric wire portion 341 of an end of a winding adjacent to electrostatic shield 350 at a portion located between an innermost periphery of the winding and an outermost periphery of the winding. As a result, conductor 352 of electrostatic shield 350 has a potential which is equal to that of electric wire portion 341 of flat type electric wire 340 located at the end of winding 320, that is located between the innermost periphery of the winding and the outermost periphery of the winding, and which is lower than the highest potential in winding 320 that stationary induction apparatus 300 comprises. Thus the two electrostatic shields 350 each have a potential lower than the highest potential in winding 320 adjacent thereto.

As a result, in stationary induction apparatus 300 according to the present embodiment, a potential of electrostatic shield 350 relative to the ground can be lower than when conductor 352 of electrostatic shield 350 is connected to the input end. This can reduce an electric field at the end on the outer peripheral side and the end on the inner peripheral side of electrostatic shield 350. In stationary induction apparatus 300 according to the present embodiment, it is not necessary to increase the thickness of electrostatic shield 350. In other words, stationary induction apparatus 300 can mitigate electric field concentration at the end on the outer peripheral side and the end on the inner peripheral side of electrostatic shield 350 while restraining electrostatic shield 350 from thickening.

While, as shown in FIG. 14, in the present embodiment, wiring 360 is connected to an external surface of conductor 352 at an outer peripheral portion thereof, it is not limited as such, and wiring 360 may be connected to the external surface of conductor 352 at an inner peripheral portion thereof. In order to further ensure insulation performance between wiring 360 and winding 320, it is preferable that conductor 352 be connected to wiring 360 at the external surface of conductor 352 at one of the inner peripheral portion and the outer peripheral portion thereof that has a smaller potential difference from winding 320 adjacent thereto. For the same reason, it is preferable that wiring 360 be disposed along a surface of second insulating coating 353 of electrostatic shield 350.

When connecting wiring 360 to electrostatic shield 350, a portion of second insulating coating 353 of electrostatic shield 350 is removed to expose conductor 352, and core wire 361 is connected to the exposed portion of conductor 352 by soldering or silver brazing. This connection portion is covered with insulating paper. When connecting wiring 360 to winding 320, a portion of first insulating coating 342 of flat type electric wire 340 is removed to expose electric wire portion 341, and core wire 361 is connected to the exposed portion of electric wire portion 341 by soldering or silver brazing. This connection portion is covered with insulating paper.

Note that a manner of electrically connecting electrostatic shield 350 is not limited to the above and may be similar to that described in the first or second exemplary variation of the first embodiment.

While a core-type transformer, a shell-type transformer and a core-type reactor have been described as a stationary induction apparatus in the embodiments above, the stationary induction apparatus may be any other stationary induction apparatus than these.

While the present invention has been described in embodiments, it should be understood that the embodiments disclosed herein are illustrative and non-restrictive in any respect. The scope of the present invention is defined by the terms of the claims, and is intended to include any modifications within the meaning and scope equivalent to the terms of the claims.

What is claimed is:

1. A stationary induction apparatus comprising:

a core;

at least one winding wound around the core such that the core serves as a central axis; and at least one annular electrostatic shield disposed at an end of the at least one winding in a direction along the central axis in a one-to-one correspondence, the at least one winding including an electric wire portion and a first insulating coating that coats the electric wire portion, the at least one electrostatic shield including a conductor and a second insulating coating that coats the conductor, the at least one electrostatic shield having a potential lower than a highest potential in the at least one winding, and wherein the conductor of the at least one electrostatic shield has a potential electrically connected to the electric wire portion of the end of the winding adjacent to the electrostatic shield only at a portion located between an innermost periphery of the winding and an outermost periphery of the winding, and thus equal to a potential thereof.

2. The stationary induction apparatus according to claim 1, wherein in a radial direction orthogonal to the direction along the central axis, the at least one electrostatic shield has a width equivalent to a width of a winding adjacent thereto.

3. The stationary induction apparatus according to claim 2, wherein the conductor is connected to a wiring at an external surface of the conductor at one of an inner peripheral portion and an outer peripheral portion thereof that has a smaller potential difference from the winding adjacent to the electrostatic shield, and is electrically connected via that wiring to the electric wire portion of the end of the winding adjacent to the electrostatic shield.

4. The stationary induction apparatus according to claim 3, wherein the wiring is disposed along a surface of the second insulating coating of the electrostatic shield.

5. The stationary induction apparatus according to claim 2, wherein the conductor of the at least one electrostatic shield has a potential electrically connected to the electric wire portion excluding the end of the winding adjacent to the electrostatic shield, and thus equal to a potential thereof.

6. The stationary induction apparatus according to claim 2, wherein the conductor of the at least one electrostatic shield is electrically floating.

7. The stationary induction apparatus according to claim 2, wherein: the second insulating coating includes an inner portion facing a winding adjacent thereto in the direction along the central axis, and an outer portion located on a side opposite to the winding adjacent thereto in the direction along the central axis; and the inner portion is thicker than the outer portion.

8. The stationary induction apparatus according to claim 2, comprising a plurality of windings as the at least one winding, wherein the plurality of windings are concentrically wound around the core.

9. The stationary induction apparatus according to claim 2, comprising a plurality of windings as the at least one winding, wherein the plurality of windings are wound around the core to be coaxially disposed.

10. The stationary induction apparatus according to claim 1, comprising:

a plurality of windings as the at least one winding; and a plurality of electrostatic shields as the at least one electrostatic shield, wherein:

the plurality of electrostatic shields are disposed adjacent to ends of the plurality of windings in a one-to-one correspondence; and the plurality of electrostatic shields each have a potential lower than a highest potential in the plurality of windings.

11. The stationary induction apparatus according to claim 10, wherein, of the plurality of electrostatic shields, an electrostatic shield adjacent to an end of a winding of the plurality of windings that has a highest potential has the conductor with a potential electrically connected to the electric wire portion of the end of the winding adjacent to the electrostatic shield at a portion located between an innermost periphery of the winding and an outermost periphery of the winding, and thus equal to a potential thereof.

12. The stationary induction apparatus according to claim 10, wherein, of the plurality of electrostatic shields, an electrostatic shield adjacent to an end of a winding of the plurality of windings that has a highest potential has the conductor with a potential electrically connected to the electric wire portion excluding the end of the winding adjacent to the electrostatic shield, and thus equal to a potential thereof.

13. The stationary induction apparatus according to claim 10, wherein the plurality of electrostatic shields each have a potential lower than a highest potential in a winding adjacent thereto in a one-to-one correspondence.

14. The stationary induction apparatus according to claim 3, wherein the wiring is composed of a core wire and a third insulating coating that coats the core wire.

* * * * *